US010153124B2

(12) United States Patent
Ku

(10) Patent No.: US 10,153,124 B2
(45) **Date of Patent: *Dec. 11, 2018**

(54) MULTI-LOAD FUSE BLOCK

(71) Applicant: GLORYTECH TECHNOLOGY CO., LTD., Taoyuan (TW)

(72) Inventor: Huan-Yao Ku, Taoyuan (TW)

(73) Assignee: GLORYTECH TECHNOLOGY CO., LTD., Taoyuan (TW)

( * ) Notice: Subject to any disclaimer, the term of this patent is extended or adjusted under 35 U.S.C. 154(b) by 6 days.

This patent is subject to a terminal disclaimer.

(21) Appl. No.: 15/480,378

(22) Filed: Apr. 6, 2017

(65) Prior Publication Data

US 2018/0294127 A1 Oct. 11, 2018

(51) Int. Cl.
*H01H 85/20* (2006.01)
*H01H 85/04* (2006.01)

(52) U.S. Cl.
CPC ..... *H01H 85/2015* (2013.01); *H01H 85/04* (2013.01); *H01H 2085/208* (2013.01); *H01H 2085/2075* (2013.01)

(58) Field of Classification Search
CPC ..... H01H 85/2015; H01H 85/04; H01H 85/2035; H01H 85/204; H01H 85/2045; H01H 2085/206; H01H 2085/2075; H01H 2085/208; H01H 2085/209; H01H 2231/026
USPC ..... 337/186, 198
See application file for complete search history.

(56) References Cited

U.S. PATENT DOCUMENTS 4,752,243 A * 6/1988 Meidan ..... H01R 13/68 337/198
6,815,841 B1 * 11/2004 Brown ..... H01H 85/046 307/10.1
7,530,851 B2 * 5/2009 Parnis ..... H01R 13/68 439/503
2002/0024414 A1 * 2/2002 Sumida ..... H01H 85/0417 337/158
2006/0286868 A1 * 12/2006 Pentell ..... H01H 85/2015 439/620.27
2007/0054546 A1 * 3/2007 Higuchi ..... H01H 85/2035 439/500
2011/0175699 A1 * 7/2011 Huss ..... H01H 85/32 337/143

* cited by examiner

*Primary Examiner* — Anatoly Vortman
*Assistant Examiner* — Jacob R Crum
(74) *Attorney, Agent, or Firm* — Leong C. Lei

(57) ABSTRACT

A multi-load fuse block, which receives insertion of at least two safety fuses therein, includes: a housing, a first surface of the housing configured with a first fuse slot and at least one second fuse slot; a conductive joint, configured on a second surface of the housing, and in electric connection with the first fuse slot; a first load conductive wire, configured on a third surface of the housing; and a second load conductive wire, configured on a fourth surface of the housing, where the first fuse slot and second fuse slot allow a plurality of safety fuses to be inserted therein or separated therefrom. The first load conductive wires and second load conductive wires of the housing can provide electric connection for automotive electronics, allowing the safety fuses to be in electric connection with more automotive electronics so as to protect them from overcurrent.

10 Claims, 6 Drawing Sheets

MULTI-LOAD FUSE BLOCK

TECHNICAL FIELD OF THE INVENTION

The present invention relates to a multi-load fuse block, and more particularly to a multi-load fuse block for the insertion of at least two safety fuses therein, allowing the fuses to be in electric connection with a greater number of automotive electronics, thereby achieving the protection thereof from overcurrent.

DESCRIPTION OF THE PRIOR ART

Safety fuses, also known as fusible cutouts, are blown to protect circuits when circuit currents are abnormal and exceed their rated values.

Today's general fuses for vehicle are roughly divided into two types of fast-blown fuses and slow-blown fuses, and common car fuses have high current fuses and low current fuses. The low current fuses are generally easier to accessible, roughly divided into chip fuses (including automotive fuse box mini fuses), plug-in fuses, screw-type fuses and tube fuse box flat-panel fuses. Among these, chip fuses can carry small current, short pulse current, such as headlight circuit, rear glass defrost; the conductor inside a chip fuse is made of metal similar to solder, the melting point of which is lower than the ones of ordinary wires, where the size of the conductor must be passed through a very precise calibration so that enough heat can be generated to blow the conductor and break the circuit when the rated current is reached.

However, electronics in modern cars become more and more, but automotive fuses insertion spaces in cars are limited; automotive fuses must be installed correspondingly to extra car electronics in the limed automotive fuses spaces for the protection thereof when they are added in cars.

SUMMARY OF THE INVENTION

The main object of the present invention is to provide a multi-load fuse block, which is capable of receiving the insertion of at least two safety fuses therein, and is in electric connection with automotive electronic devices through first load conductive wires and second load conductive wires of a housing, allowing the safety fuses to be in electric connection with more automotive electronics so as to protect them from overcurrent.

To achieve the object mentioned above, the present invention proposes a multi-load fuse block, which is adapted to receiving the insertion of at least two safety fuses therein, including: a housing, having a first surface, a second surface, a third surface and a fourth surface, the first surface of the housing configured with a first fuse slot and at least one second fuse slot arranged in sequence, and the second fuse slot having a first slot hole, a second slot hole and a third slot hole; a conductive joint, configured on the second surface of the housing, and in electric connection with the first fuse slot; a first load conductive wire, having a positive terminal and a load end, and configured on the third surface of the housing, the load end of the first load conductive wire in electric connection with the first slot hole, and the positive terminal of the first load conductive in electric connection with the second slot hole; and a second load conductive wire, having a positive terminal and a load end, and configured on the fourth surface of the housing, the load end of the second load conductive wire in electric connection with the third slot hole, and the positive terminal of the second load conductive wire in electric connection with the second slot hole, wherein the first fuse slot and second fuse slot are adapted to allow a plurality of safety fuses to be inserted therein or separated therefrom.

According to the fuse block mentioned above, the first surface of the housing is perpendicular to the second surface of the housing, and the conductive joint is configured on the second surface of the housing and extended vertically outward therefrom.

According to the fuse block mentioned above, the first surface of the housing is parallel to the second surface of the housing, and the conductive joint is configured on the second surface of the housing and extended vertically outward therefrom.

According to the fuse block mentioned above, the third surface of the housing is opposite to the fourth surface of the housing.

According to the fuse block mentioned above, each of the safety fuses has three conductive blades, and the safety fuses are inserted correspondingly in the first fuse slot and second fuse slot with the conductive blades.

According to the fuse block mentioned above, the three conductive blades respectively are a first conductive blade, a second conductive blade and a third conductive blade, the first conductive blade being a load end, the second conductive blade being a positive terminal, and the third conductive blade being a load end.

According to the fuse block mentioned above, the conductive joint has three conductive blades.

According to the fuse block mentioned above, the three conductive blades respectively are a first conductive blade, a second conductive blade and a third conductive blade, the first conductive blade being a load end, the second conductive blade being a positive terminal, and the third conductive blade being a load end.

According to the fuse block mentioned above, the first load conductive wire and second load conductive wire respectively provide electric connection for an automotive electronic device.

According to the fuse block mentioned above, the automotive electronic device is chosen from one among a group constituted by an air conditioning, driving recorder, satellite navigation, cigarette lighter, sound and tire display

DETAILED DESCRIPTION OF THE PREFERRED EMBODIMENTS

Figure 1:
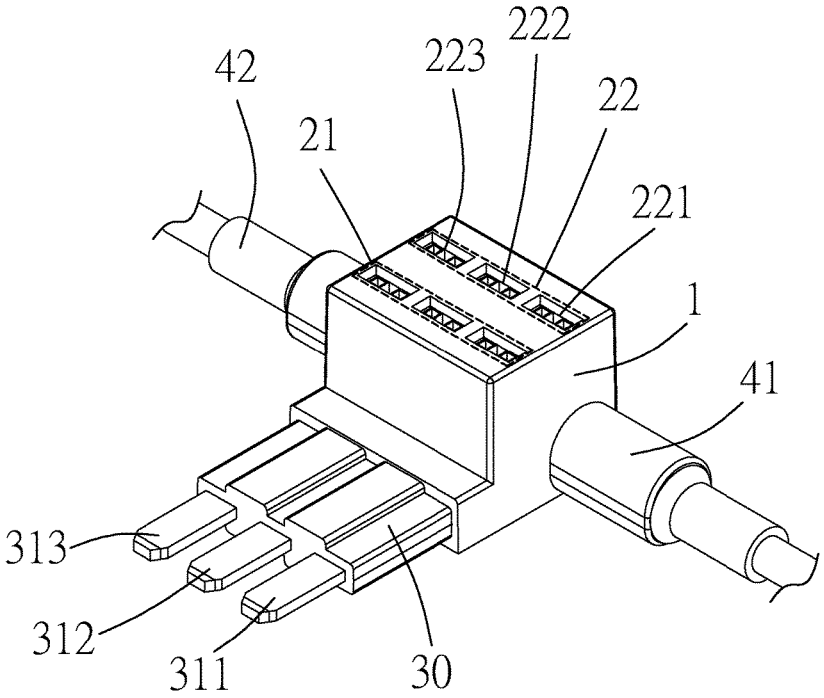
FIG. 1 is a perspective view of a first preferred embodiment of the present invention.
Figure 2:
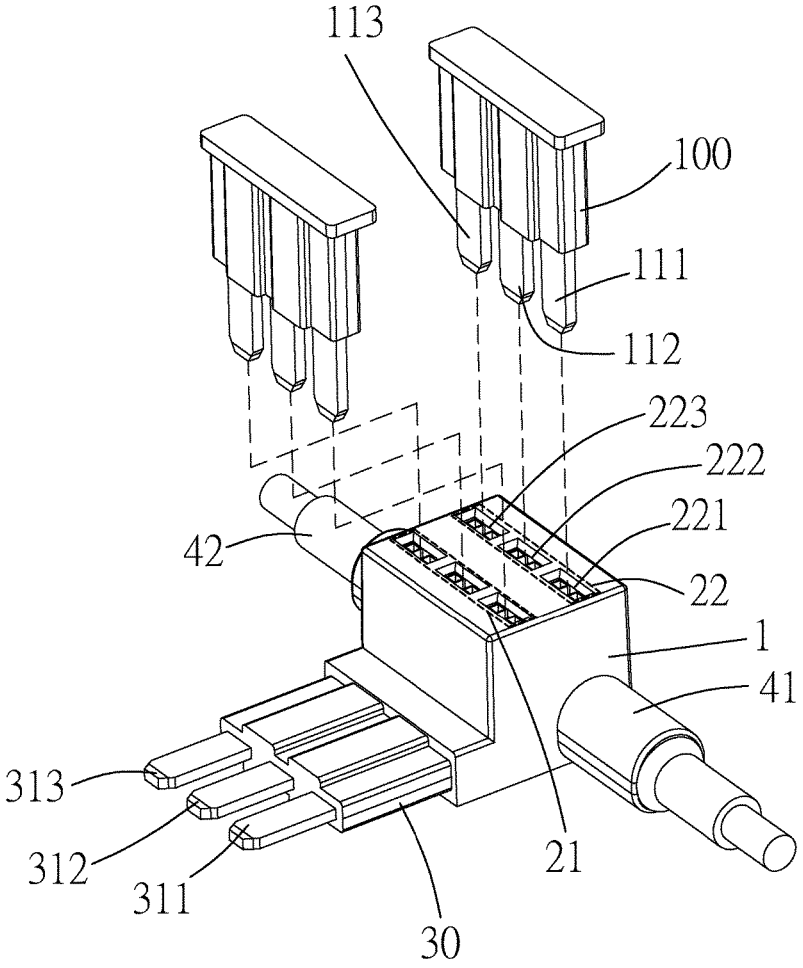
FIG. 2 is a perspective view of the first embodiment of the present invention, showing the combination and separation of safety fuses.
Figure 3:
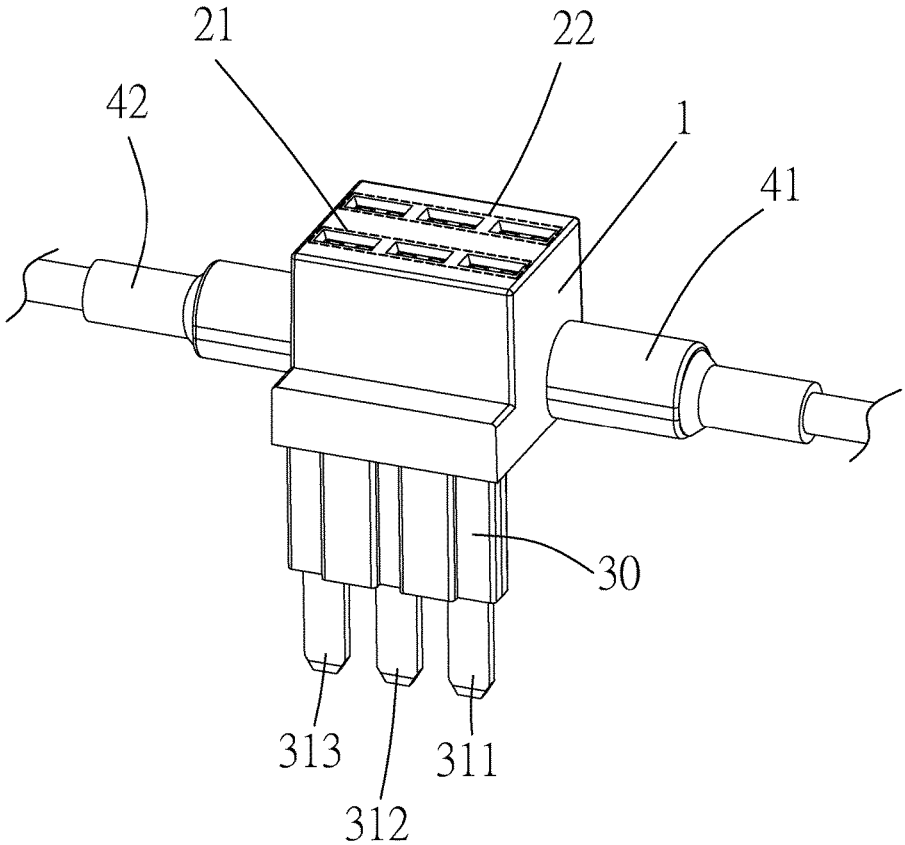
FIG. 3 is a perspective view of a second preferred embodiment of the present invention.
Figure 4:
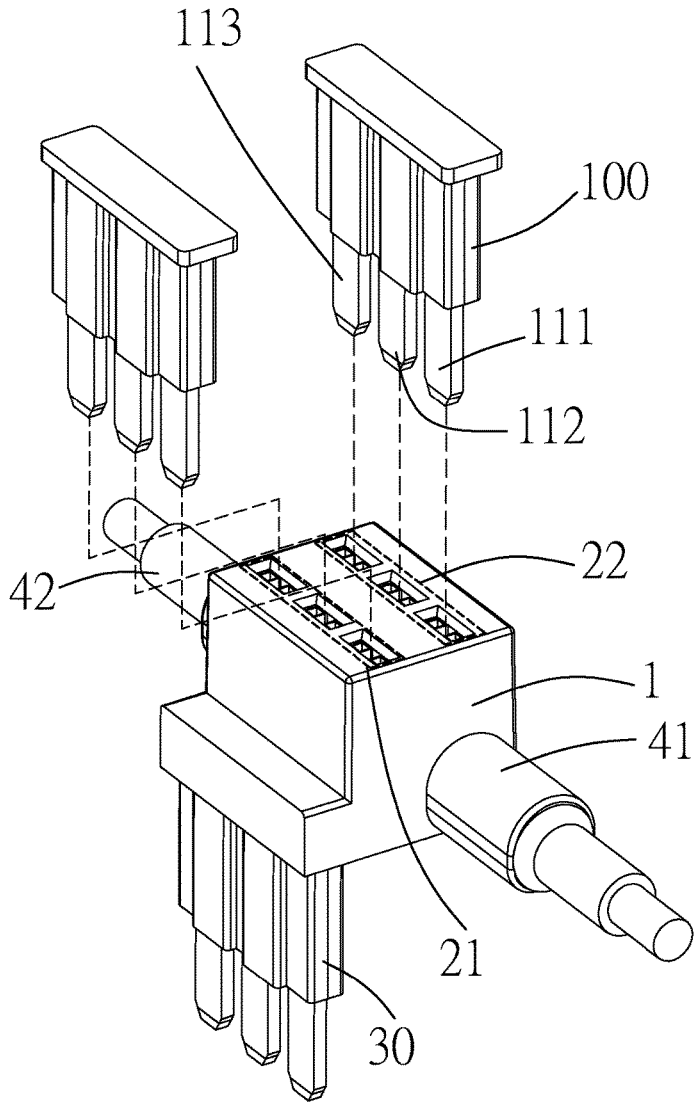
FIG. 4 is a perspective view of the second embodiment of the present invention, showing the combination and separation of safety fuses.

Referring to FIGS. 1 to 6, a multi-load fuse block of the present invention is suitable for the insertion of at least two safety fuses therein. The multi-load fuse block includes: a housing 1, having a first surface, second surface, third surface and fourth surface, the first surface configured with a first fuse slot 21 and second fuse slot 22 arranged in sequence, and the second fuse slot 22 having a first slot hole 221, second slot hole 222 and third slot hole 223; a conductive joint 30, configured on the second surface of the housing 1, and in electric connection with the first fuse slot 21; a first load conductive wire 41, having a positive terminal and a load end, and configured on the third surface, the load end of the first load conductive wire 41 in electric connection with the first slot hole 221, and the positive terminal thereof in electrical connection with the second slot hole 222; and a second load conductive wire 42, having a positive terminal and a load end, and configured on the fourth surface of the housing 1, the load end of the second load conductive wire 42 in electric connection with the third slot hole 223, and the positive terminal thereof in electrical connection with the second slot hole 222, where the first fuse slot 21 and second fuse slot 22 allow a plurality of safety fuses 100 to be combined therewith or separated therefrom correspondingly.

Referring to FIGS. 1 and 2 again, in a first preferred embodiment of the present invention, the first surface of the housing 1 is configured with the first fuse slot 21 and at least one second fuse slot 22; the first surface of the housing 1 is perpendicular to the second surface of the housing 1; the conductive joint 30 is configured on the second surface of the housing 1 and extended vertically outward therefrom, where the conductive joint 30 has three conductive blades respectively being a first conductive blade 311, a second conductive blade 312 and a third conductive blade 313, where the first conductive blade 311 is a load end; the second conductive blade 312 is a positive terminal; and the third conductive blade 313 is a load end. Further, each of the safety fuses 100 has three conductive blades, and the safety fuses 100 are respectively inserted correspondingly in the first fuse slot 21 and second fuse slot 22 with the conductive blades respectively being a first conductive blade 111, a second conductive blade 112 and a third conductive blade 113, where the first conductive blade 111 is a load end; the second conductive blade 112 is a positive terminal; and the third conductive blade 113 is a load end. Furthermore, the third surface of the housing 1 is opposite to the fourth surface of the housing 1; the first load conductive wire 41 is configured on the third surface of the housing 1; and the second load conductive wire 42 is configured on the fourth surface of the housing 1, where the first load conductive wire 41 and the second load conductive wire 42 may respectively be in electric connection with an automotive electronic device, which is an air conditioning system, a driving recorder, a satellite navigation system, a cigarette lighter, a sound or tire display (also referring to FIG. 6).

Referring to FIGS. 3 and 4 again, which show a second preferred embodiment of the present invention, the second embodiment is almost similar to the first embodiment mentioned above except the first surface of the housing 1 is parallel to the second surface of the housing 1. The first surface of the housing 1 is configured with the first fuse slot 21 and at least one second fuse slot 22; the conductive joint 30 is configured on the second surface of the housing 1 and extended vertically outward therefrom. Furthermore, the third surface of the housing 1 is opposite to the fourth surface of the housing 1; the first load conductive wire 41 is configured on the third surface of the housing 1; and the second load conductive wire 42 is configured on the fourth surface of the housing 1, where the first load conductive wire 41 and the second load conductive wire 42 may respectively be in electric connection with an automotive electronic device, which is an air conditioning system 51, a driving recorder 52, a satellite navigation system 53, a cigarette lighter 54, a sound 55 or tire display 56 (also referring to FIG. 6).

Figure 5:
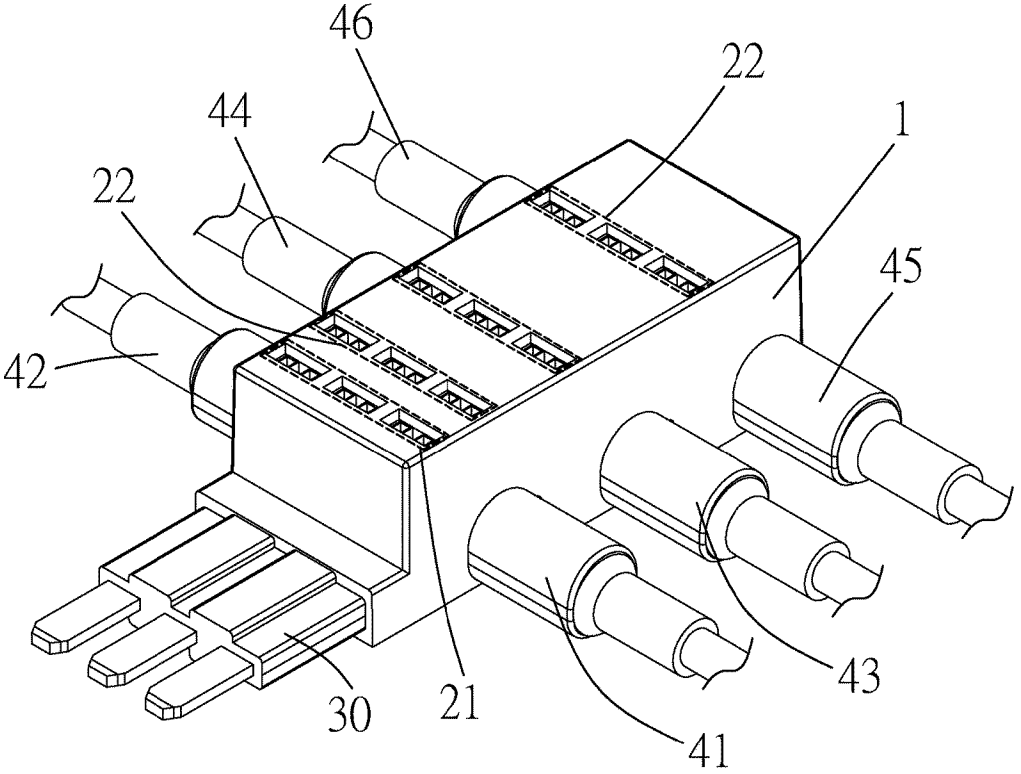
FIG. 5 is a perspective view of a third preferred embodiment of the present invention.
Figure 6:
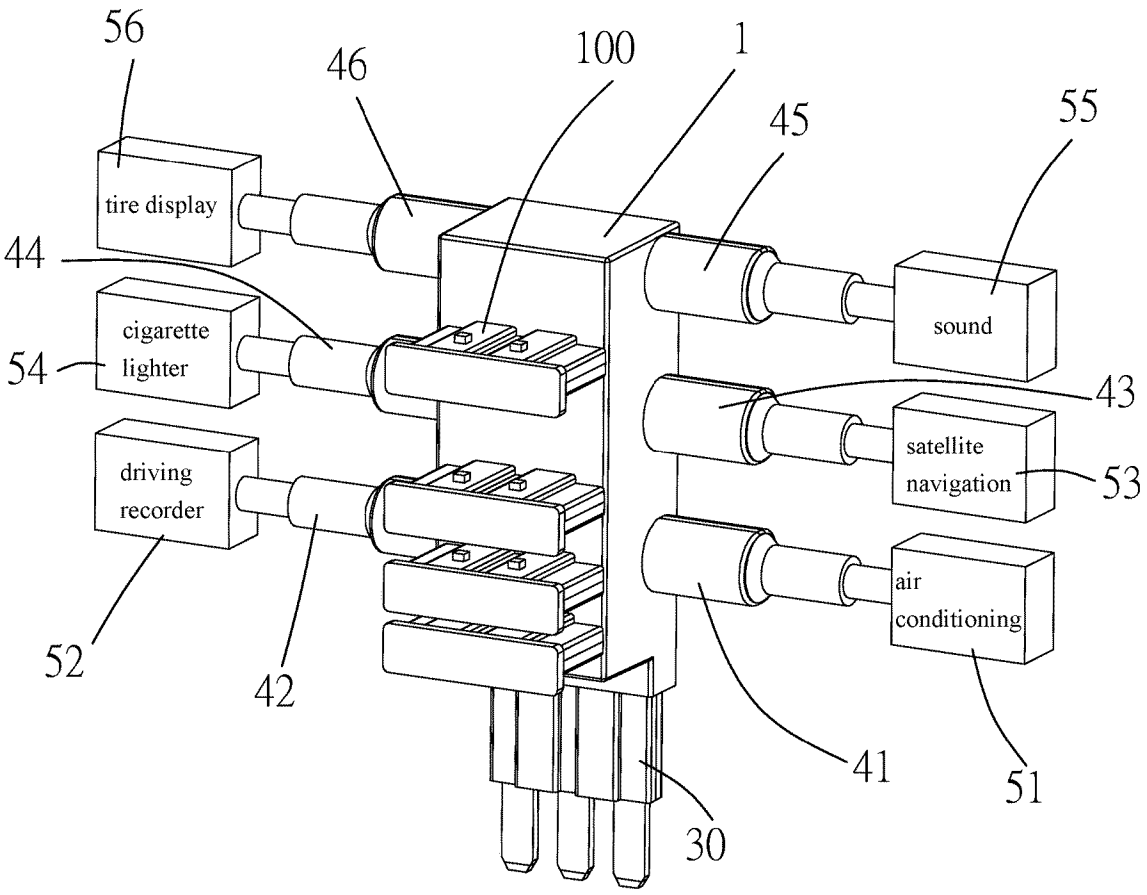
FIG. 6 is a perspective view of the third embodiment of the present invention, where a plurality of conductive wires are in electric connection with a plurality of automotive electronics.

Finally, referring to FIGS. 5 and 6, which show a third preferred embodiment of the present invention, the third embodiment is almost similar to the first embodiment mentioned above except the first surface of the housing 1 is configured with a first fuse slot 21 and a plurality of second fuse slots 22, and the housing 1 is configured with a plurality of load conductive wires 41, 42, 43, 44, 45 and 46, where the plurality of second fuse slots 22 are respectively in electric connection with the plurality of corresponding load conductive wires 41, 42, 43, 44, 45 and 46, as shown in FIG. 5. In FIG. 6, the plurality of load conductive wires 41, 42, 43, 44, 45 and 46 are respectively in electric connection with corresponding electronics, which are an air conditioning system 51, a driving recorder 52, a satellite navigation system 53, a cigarette lighter 54, a sound 55 and tire display 56. The plurality of load conductive wires 41, 42, 43, 44, 45 and 46 of the housing 1 are in electric connection with automotive electronics, allowing the safety fuses to be in electric connection with more automotive electronics so as to protect more automotive electronics from overcurrent.

I claim:

1. A multi-load fuse block, adapted to the insertion of at least two safety fuses therein, comprising:

a housing, which has a first surface, a second surface, a third surface and a fourth surface, said first surface being formed with a first fuse slot and at least one second fuse slot arranged in sequence, and said second fuse slot having a first slot hole, a second slot hole and a third slot hole;

a conductive joint, which is mounted on said second surface of said housing and is in electric connection with said first fuse slot;

a first load conductive wire, which is mounted to said third surface of said housing, said first load conductive wire being in electric connection with said first slot hole and said second slot hole; and a second load conductive wire, which is mounted on said fourth surface of said housing, said second load conductive wire being in electric connection with said third slot hole and said second slot hole, wherein said first fuse slot and second fuse slot allow a plurality of safety fuses to be inserted therein or separated therefrom;

wherein the first slot hole, the second slot hole, and the third slot hole of the second fuse slot are arranged in a first line extending between the third surface and the fourth surface of the housing such that the first slot hole is adjacent to the third surface of the housing and electrically connected with the first load conductive wire that is mounted to the third surface; and the third slot hole is adjacent to the fourth surface of the housing and electrically connected with the second load conductive wire that is mounted to the fourth surface, wherein the first and third slot holes are opposite to each other about the second slot hole and the first and second load conductive wires are opposite to each other about the second slot hole;

wherein the first fuse slot comprises a first receptacle hole, a second receptacle hole, and a third receptacle hole that are arranged in a second line extending between the third surface and the fourth surface, the second line being substantially parallel with the first line defined by the extension of the first slot hole, the second slot hole, and the third slot hole of the second fuse slot; and the first receptacle hole, the second receptacle hole, and the third receptacle hole of the first fuse slot respectively correspond to the first slot hole, the second slot hole, and the third slot hole of the second fuse slot.

2. The fuse block according to claim 1, wherein said first surface of said housing is perpendicular to said second surface of said housing, and said conductive joint is arranged on said second surface of said housing and extended vertically outward therefrom.

3. The fuse block according to claim 1, wherein said first surface of said housing is parallel to said second surface of said housing, and said conductive joint is arranged on said second surface of said housing and extended vertically outward therefrom.

4. The fuse block according to claim 1, wherein said third surface of said housing is opposite to said fourth surface of said housing.

5. The fuse block according to claim 1, wherein each of said safety fuses has three conductive blades, and said safety fuses are respectively inserted in said first fuse slot and said second fuse slot with said conductive blades.

6. The fuse block according to claim 5, wherein said three conductive blades are respectively a first conductive blade, a second conductive blade and a third conductive blade, said first conductive blade being a load end, said second conductive blade being a positive terminal, and said third conductive blade being a load end.

7. The fuse block according to claim 1, wherein said conductive joint has three conductive blades.

8. The fuse block according to claim 7, wherein said three conductive blades are respectively a first conductive blade, a second conductive blade and a third conductive blade, said first conductive blade being a load end, said second conductive blade being a positive terminal, and said third conductive blade being a load end.

9. The fuse block according to claim 1, wherein said first load conductive wire and said second load conductive wire respectively provide electric connection for an automotive electronic device.

10. The fuse block according to claim 9, wherein said automotive electronic device is chosen from one among a group constituted by an air conditioning, a driving recorder, a satellite navigation, a cigarette lighter, a sound and tire display.

* * * * *